US008328258B2

(12) United States Patent
Kjol

(10) Patent No.: US 8,328,258 B2
(45) Date of Patent: Dec. 11, 2012

(54) GRIPPING TOOL FOR A CRANE

(75) Inventor: Andreas Kjol, Alesund (NO)

(73) Assignee: Rolls-Royce Marine AS, Alesund (NO)

( * ) Notice: Subject to any disclaimer, the term of this patent is extended or adjusted under 35 U.S.C. 154(b) by 0 days.

(21) Appl. No.: 13/063,975

(22) PCT Filed: Sep. 16, 2009

(86) PCT No.: PCT/EP2009/061995

§ 371 (c)(1),
(2), (4) Date: Apr. 14, 2011

(87) PCT Pub. No.: WO2010/043464

PCT Pub. Date: Apr. 22, 2010

(65) Prior Publication Data

US 2011/0204666 A1 Aug. 25, 2011

(30) Foreign Application Priority Data

Sep. 16, 2008 (NO) ..... 2008 3949

(51) Int. Cl.
*B66C 1/42* (2006.01)
*B66C 3/00* (2006.01)

(52) U.S. Cl. ..... 294/198; 294/106

(58) Field of Classification Search ..... 294/198, 294/201, 86.4, 106, 902; 144/4.1, 34.1, 34.5; 414/555, 731, 739; 901/37
See application file for complete search history.

(56) References Cited

U.S. PATENT DOCUMENTS 3,044,819 A * 7/1962 Pierre ..... 294/198
3,165,348 A * 1/1965 Keskitalo ..... 294/198
3,589,766 A * 6/1971 Bormioli ..... 294/106
3,727,653 A * 4/1973 Tucek ..... 144/34.1
3,910,326 A * 10/1975 Tucek ..... 294/106
3,911,981 A * 10/1975 Tucek ..... 294/106
4,303,269 A * 12/1981 Faughnan ..... 294/198
5,588,688 A * 12/1996 Jacobsen et al. ..... 294/106
6,637,482 B2 * 10/2003 Koponen ..... 144/4.1
7,052,060 B2 * 5/2006 Vigholm et al. ..... 294/198

FOREIGN PATENT DOCUMENTS

GB 1241818 A 8/1971
GB 2021516 A 12/1979
JP 07 267572 A 10/1995
JP 2007 301439 A 11/2007
SU 701918 A1 12/1979
WO WO-2006/123934 A2 11/2006

OTHER PUBLICATIONS

Özsoy, Sevda, "International Search Report", for PCT/EP2009/061995 as mailed Dec. 15, 2009, 4 pages.

* cited by examiner

*Primary Examiner* — Paul T Chin
(74) *Attorney, Agent, or Firm* — Winstead PC

(57) ABSTRACT

A gripping tool includes a bracket for connecting the gripping tool to a crane. The gripping tool further includes a main body connected to the bracket and a plurality of jaw members pivotally arranged on the main body. The plurality of jaw members are controlled by a plurality of actuators and are arranged to cooperatively grip and hold goods to be lifted or manipulated. A supplementary jaw member is displaceably connected to a first jaw member of the plurality of jaw members. The supplementary jaw member is displaced from a position where a gripping surface of the supplementary jaw member rests against a gripping surface of an outer surface of the first jaw member to a position where the gripping surface of the supplementary jaw member is separated by a distance from the gripping surface of the first jaw member.

3 Claims, 5 Drawing Sheets

GRIPPING TOOL FOR A CRANE

FIELD OF INVENTION

The present invention relates to a tool for a crane. More specifically the invention relates to a gripping tool to be arranged at the end of a crane arm for handling of chains, wires, cables, ropes, shackles, etc., onboard a vessel, where one or more cranes are arranged on or adjoining the deck of the vessel.

BACKGROUND

During the last decade or so in increased focus on safety has resulted in development of solutions for making the working situation for deckhands working at the work deck of anchor handling vessels and other service vessels offshore, safer. Many of the solutions includes introduction of tools that makes it possible to avoid having personnel doing manual work at the most exposed positions and close to moving equipment at the working, of aft, deck. Automation and introduction of robot systems have made it possible to withdraw personnel from the exposed and most dangerous positions.

WO2006123934 describes a crane comprising a base part that preferably is arranged movable along the cargo rail of the working deck. The base part is rotary arranged to allow the craned to be operated 360°. A main boom is arranged at base part and may be operated by means of one ore more hydraulic cylinder(s). Two working jibs are arranged at the outward extending part of the main jib, each of which working jibs may be driven by individual hydraulic cylinders. Tools are arranged at the free end of the working jibs. A first tool is a chain claw. The chain claw comprises a U-shaped jaw part, and a movable jaw part that is adopted to handle chains. Another tool is a hooking tool, comprising a hooking member that may be retracted into a protective member when not in use. A third tool is a wire twister that is adopted to grip and twist wires.

The tool according to WO2006123934 solves some of the tasks to replace manual work at the exposed working deck, but device is dependent on the use of several working jibs at a crane and the use of different tools.

SU 701918 relates to a hydraulic grab for carrying long loads, such as timber. A supplementary jaw on one of the main jaws to enable gripping of single loads is also provided. The supplementary jaw is pivotally connected to the main jaw and is operated by means of a hydraulic actuator. Accordingly, the resulting supplementary grab for single loads depends on loads having a diameter within relatively narrow limits to work optimally, a diameter resulting in the gripping surfaces of the supplementary jaw and the main jaws being substantially parallel. When gripping over an object having a larger diameter, the object in the jaw will be forced out of the gripping device when gripping.

An object of the present invention is to provide a flexible multipurpose tool for a crane, for performing tasks as:

- Handling of wire, including wire torsion control,
- Handling of chains,
- Handling of fiber rope
- Pennant catching, lasso tool for buoy catching,
- Different anchor handling operations, such as pushing and pulling objects on deck,
- Pennant delivery,
- Handling of chain and cutting of wire.

The tools described above will not have the flexibility needed for a multipurpose tool according to the object of the present invention.

SUMMARY OF THE INVENTION

The objects above is met by a gripping tool for a crane or the like, comprising a bracket for connecting the tool to the crane or the like, a main body connected to the bracket, where jaw parts are pivotally arranged on the main body, where the jaw parts are controlled by actuators and where the jaw parts are arranged so that they may cooperatively grip and hold goods to be lifted or manipulated, wherein an supplementary jaw member is displaceably arranged on one of the jaw parts can be displaced from a position where a gripping surface on the supplementary jaw member rests against a gripping surface of the outer surface of the jaw member, to a position where the gripping surface has a distance to the gripping surface of the jaw member, and where the displacement of gripping surface is a substantially parallel displacement.

SHORT DESCRIPTION OF THE FIGURES

DETAILED DESCRIPTION OF THE INVENTION

The present gripping tool is intended to be arranged at the end of a crane arm or the like for the handling of different goods.

Figure 1:
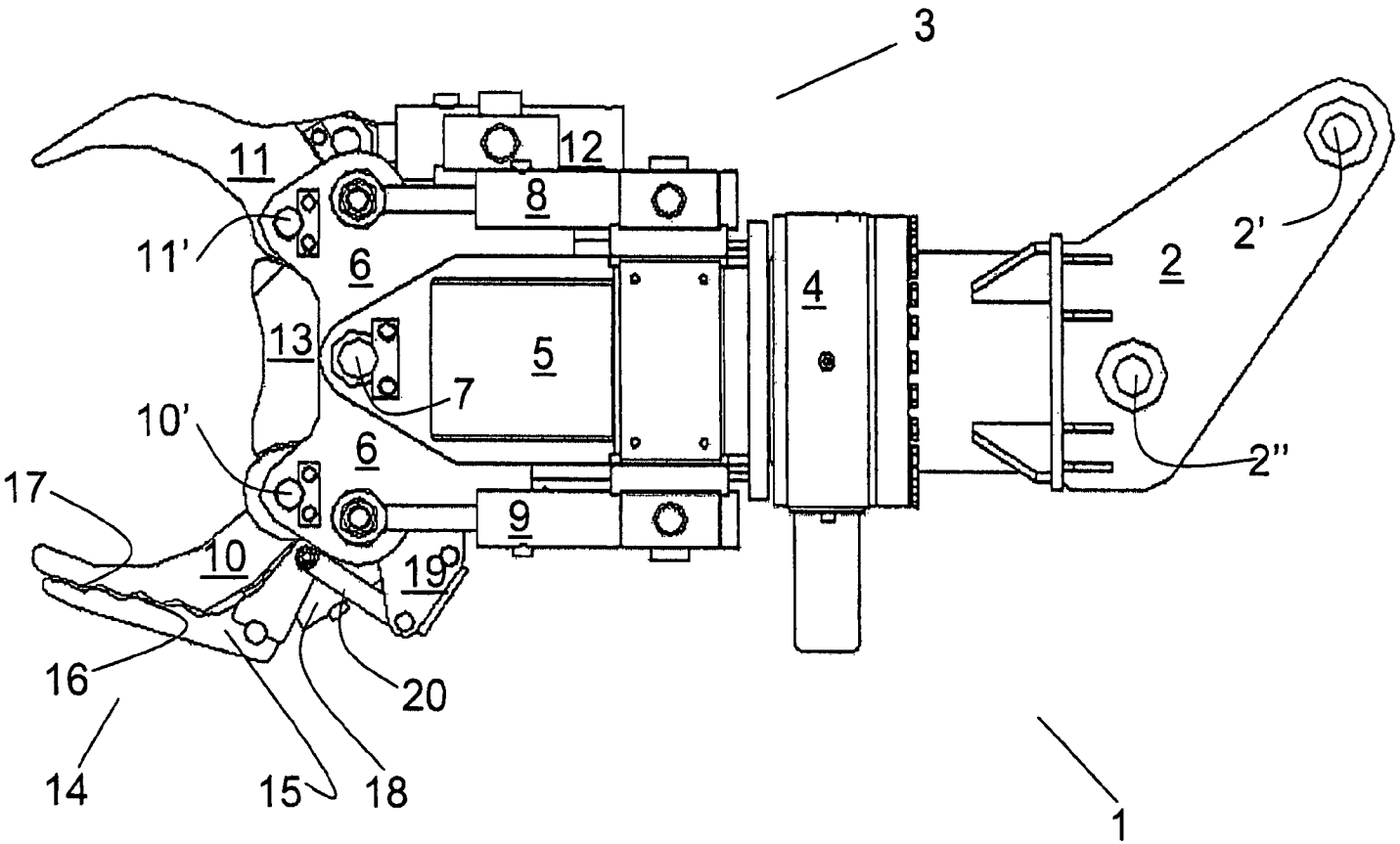
FIG. 1 is a side view of the present gripping tool in a first position.
Figure 2:
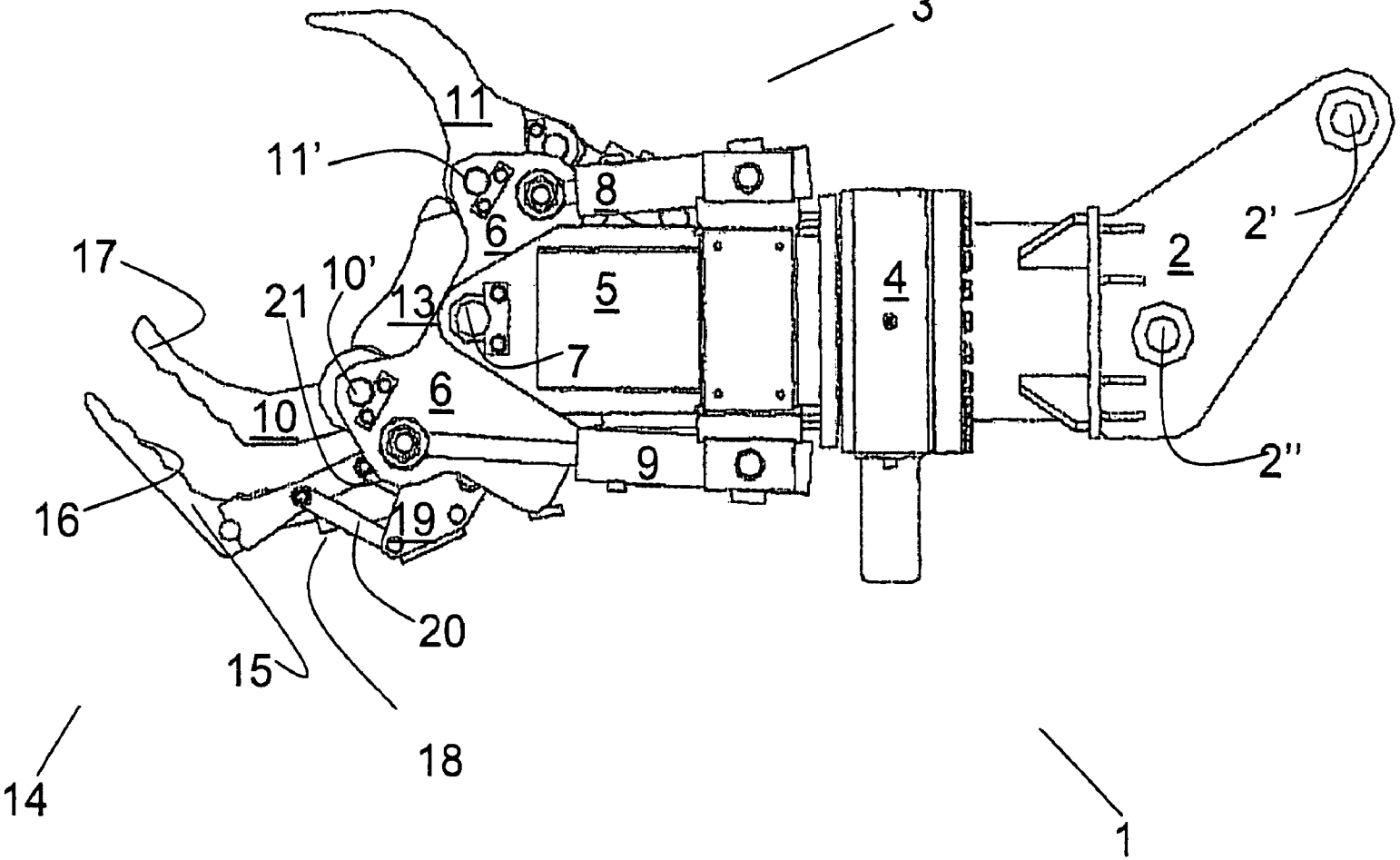
FIG. 2 is a side view of the present gripping tool in a second position.
Figure 3:
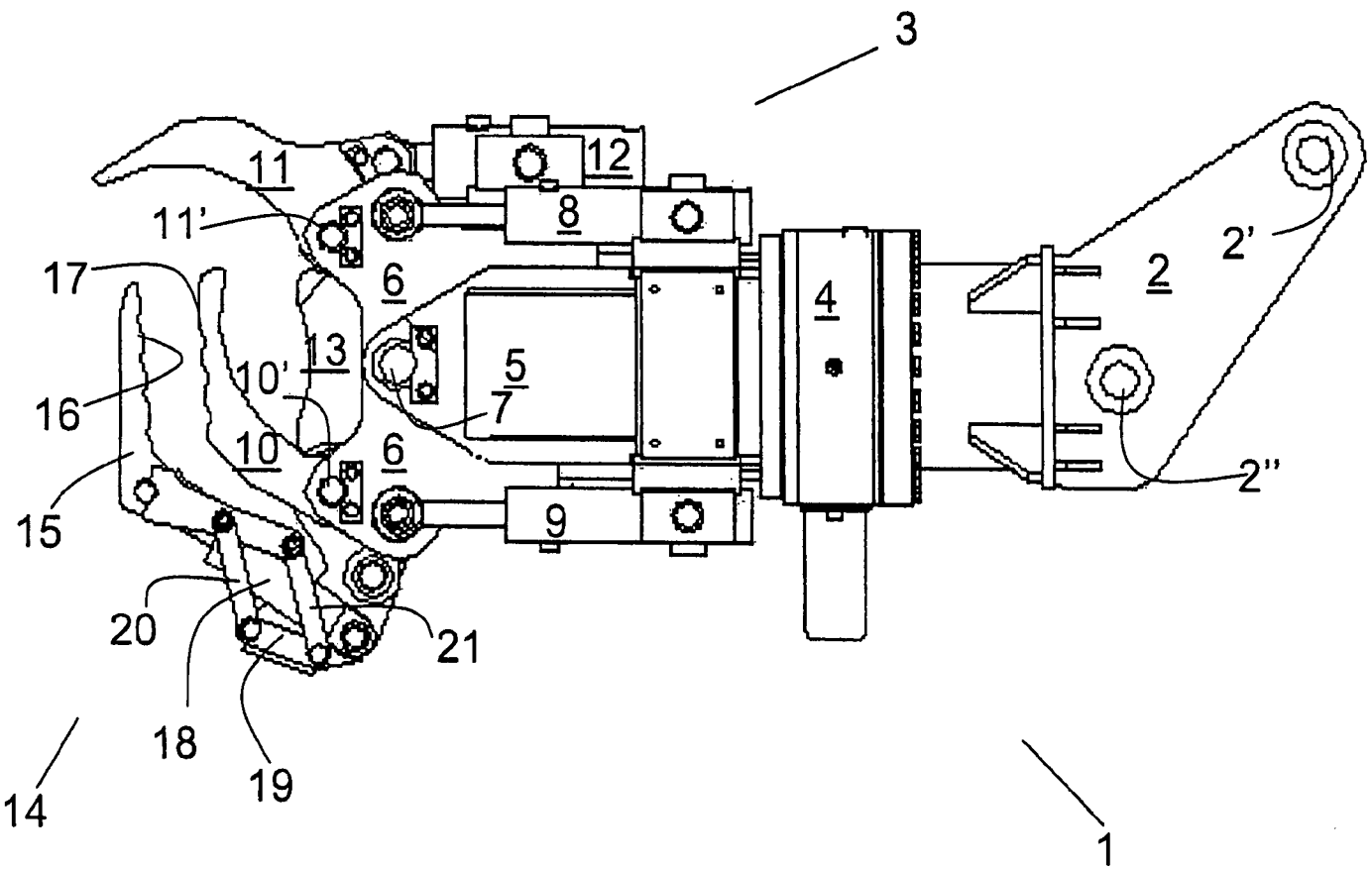
FIG. 3 is a side view of the present gripping tool in a third position.
Figure 4:
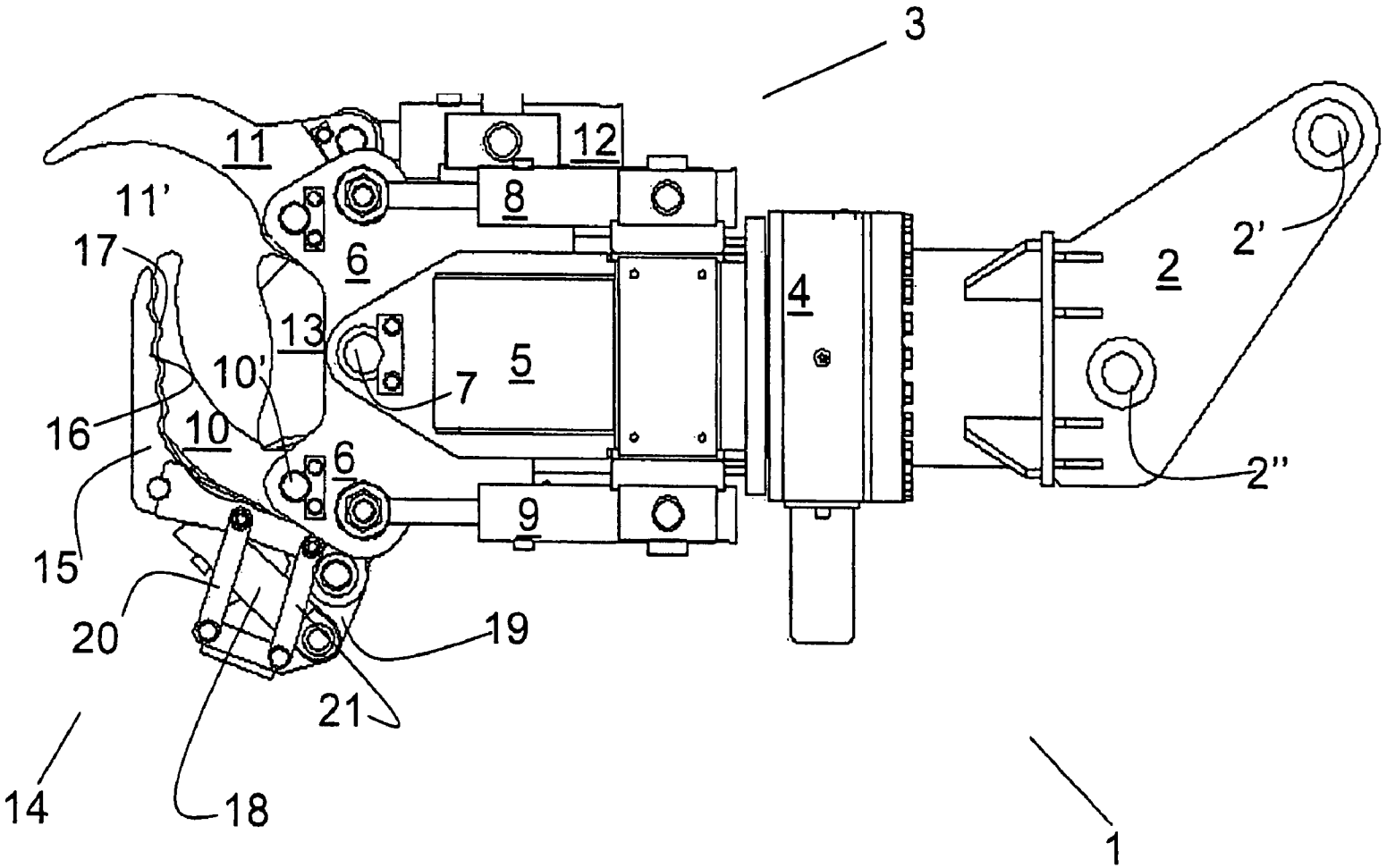
FIG. 4 is a side view of the present gripping tool in a forth position.
Figure 5:
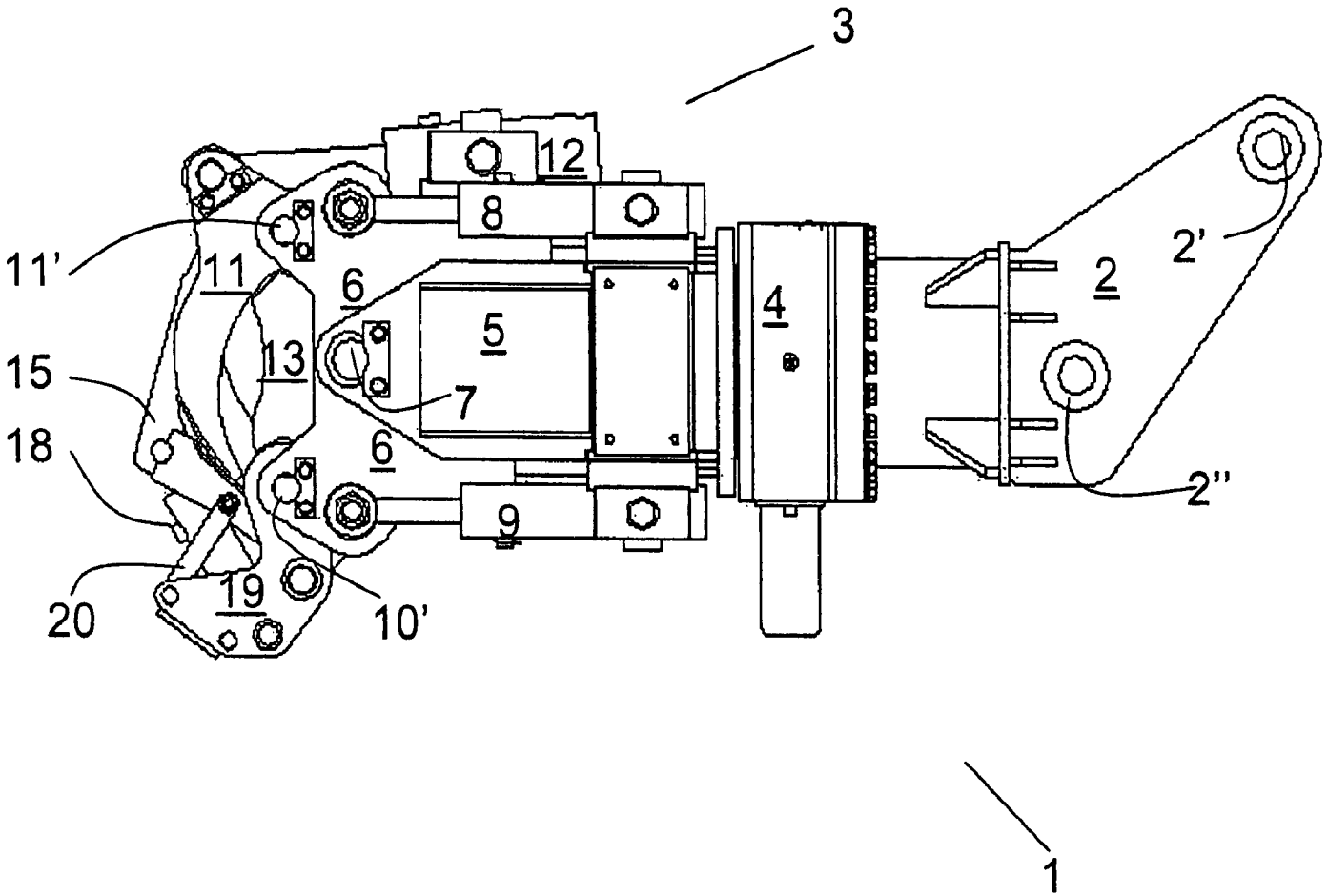
FIG. 5 is a side view of the present gripping tool in a fifth position.

FIG. 1 is a side view of a gripping tool 1 according to the present invention. The gripping tool 1 may be pivotally connected to a crane by means of connection bolts running through connection holes 2', 2" of a bracket 2 in a conventional way.

The bracket 2 is preferably connected to a base part 5 of the gripping part 3 of the tool via a turntable 4, allowing the base part 5 to rotate 360° about an axis in the longitudinal direction of the tool.

A main body 6 is pivotally connected to the base part 5 via a rotation axis 7. The relative position of the main body 6 relative to the base part 5 is controlled by hydraulic cylinders 8, 9 that are connected to both the base part 5 and to the main body 6.

A first 10, and a second 11 jaw member are pivotally connected to the main body 6 about pivot axis 10', 11', respectively. The pivoting of the jaw members relative to the main body is controlled by means of hydraulic cylinders 12 for opening and closing of the jaw. Due to the construction of the tool only one of the hydraulic cylinders 12 for operating the jaw members 10, 11, is shown, as the other hydraulic cylinder is hidden behind the main body 6 and base member 5 in the figures. The jaw members are preferably independently operated. A supporting member 13 is connected to the main body 6 to give support for the goods to be gripped by the first and second jaw members 10, 11.

The tool also comprises an alternative gripping device 14 comprising a supplementary jaw member 15 that is displaceably connected to one of the jaw members, here illustrated on jaw member 10. The supplementary jaw member 15 is displaceably arranged so that it may be displaced from a position where a gripping surface 16 on the supplementary jaw member 15 rests against a gripping surface 17 of the outer surface of the jaw member 10, to a position where the gripping surface 16 has a distance to the gripping surface 17 of the jaw member. A hydraulic cylinder 18 is provided to adjust the gap between the gripping surfaces 16, 17 and force the two gripping surfaces 16, 17 together to hold objects between the jaw member and the supplementary jaw member.

The hydraulic cylinder 18 is arranged between and is connected parallel holding brackets 19 fastened to the jaw member 10, and to the supplementary jaw member 15. The supplementary gripping member 19 is connected to the parallel holding brackets by means of two or more pair of bars 20, 21 that are arranged spaced apart from each other and being substantially parallel to each other. The bars 20, 21 are pivotally connected to both the parallel holding brackets 19 and the supplementary jaw member 15, so that the gripping surfaces 16, 17 are moving substantially parallel to each other when the hydraulic cylinder 18 is operated.

The present tool is described to comprise means to tilt the tool and to rotate the tool. Said means may be omitted if said parts are included at the free end of the crane, or may be arranged between the present tool and the free end of the crane jib.

The present gripping tool may also be designed having shearing edges substituting the gripping surfaces 16, 17 to make it possible to use the gripping tool as a wire cutter. It is also possible to arrange supplementary jaw members at both the jaw members 10, 11, where the gripping surfaces 16, 17 connected to one of the jaw parts is substituted by cutting edges and the other is as described above.

The invention claimed is:

1. A gripping tool comprising:

a bracket for connecting the gripping tool to a crane;

a main body connected to the bracket;

a plurality of jaw members pivotally arranged on the main body;

wherein the plurality of jaw members are controlled by a plurality of actuators and are arranged to cooperatively grip and hold goods to be lifted or manipulated;

a supplementary jaw member displaceably connected to a first jaw member of the plurality of jaw members;

wherein the supplementary jaw member is displaced from a position where a gripping surface of the supplementary jaw member rests against a gripping surface of an outer surface of the first jaw member to a position where the gripping surface of the supplementary jaw member is separated by a distance from the gripping surface of the first jaw member;

wherein the displacement of the gripping surface is substantially parallel; and wherein the supplementary jaw member is connected to a parallel holding bracket at the first jaw member via at least two pairs of bars that are spaced apart from each other and are pivotally connected to the supplementary jaw member and the parallel holding bracket.

2. The gripping tool according to claim 1, wherein the supplementary jaw member is controlled by a supplementary jaw member actuator.

3. The gripping tool according to claim 1, wherein the plurality of actuators are hydraulic actuators.

* * * * *